US006302398B1

(12) United States Patent
Vecchio

(10) Patent No.: US 6,302,398 B1
(45) Date of Patent: Oct. 16, 2001

(54) METHOD OF PLAYING A WILD CARD GAME AND RELATED DECK OF CARDS

(75) Inventor: Robert Vecchio, Woodbridge, CT (US)

(73) Assignee: LTB, LLC, New Haven, CT (US)

( * ) Notice: Subject to any disclaimer, the term of this patent is extended or adjusted under 35 U.S.C. 154(b) by 0 days.

(21) Appl. No.: 09/712,753

(22) Filed: Nov. 14, 2000

(51) Int. Cl.[7] ..... A63F 1/00
(52) U.S. Cl. ..... 273/292; 273/306
(58) Field of Search ..... 273/292, 306, 273/309; 463/12

(56) References Cited

U.S. PATENT DOCUMENTS

| | | | |
|---|---|---|---|
| 5,538,252 | * | 7/1996 | Green . |
| 5,549,300 | * | 8/1996 | Sardarian . |
| 5,605,333 | * | 2/1997 | Field . |
| 5,954,335 | | 9/1999 | Moody . |
| 5,979,897 | | 11/1999 | Grossman . |
| 6,000,699 | | 12/1999 | Long . |
| 6,113,102 | | 9/2000 | Marks et al. . |

OTHER PUBLICATIONS

Casino Gamblig Concepts Inc. Spr Bacjak, Copy right 1993–1995.*

* cited by examiner

*Primary Examiner*—Jeanette Chapman
*Assistant Examiner*—Nini F. Legesse
(74) *Attorney, Agent, or Firm*—DeLio & Peterson, LLC

(57) ABSTRACT

A method of playing a card game and a deck of cards for playing the card game. The method includes dealing one face-up card to each player and one face-down card to the dealer from a deck of cards according to the invention. The object is to reach eleven, or as close thereto as possible without exceeding eleven. The deck of cards includes at least six cards of each value from one to eight and at least one wild card, and more preferably, at least four wild cards. Wild cards have any desired value from one to eleven. A player wins immediately if he initially receives a wild card, unless the dealer also initially receives a wild card, and vice-a-versa. Provided the dealer and at least one player do not receive a wild card, play continues, with each player having the choice of resting or requesting additional cards, one at a time. A player loses if the total value of the cards received by the player exceeds eleven. After all players have rested, the dealer continues. The dealer must rest immediately if the first card received by the dealer exceeds six. If not, the dealer must take additional cards until the total value of the cards received by the dealer is seven or more. The dealer loses against all remaining players if the total value of the cards received by the dealer exceeds eleven. A player wins if the value of the player's cards exceeds the value of the dealer's cards, and vice-a-versa.

18 Claims, 2 Drawing Sheets

METHOD OF PLAYING A WILD CARD GAME AND RELATED DECK OF CARDS

BACKGROUND OF THE INVENTION

1. Field of the Invention

This invention relates to card games that use wild cards, particularly card games of the type that are often played as casino games. The invention also is directed to a deck of cards used to play the game of the present invention.

2. Description of Related Art

The game of Twenty-One or Blackjack is a popular and exciting game of chance that is widely played in casinos around the world. One attraction of this game is that it is played rapidly with a limited number of cards. A player's hand can include as few as two cards. This leads to rapid and exciting play.

Another attraction to this game is that aces are multi-valued, i.e., they can be worth either one or eleven. This adds another element of excitement to the game.

Despite the advantageous features of Twenty-One, however, there is still a desire for faster action and greater excitement in card games. The present invention provides such faster action by providing a game that can have hands with as few as a single card and by providing a special deck of cards with wild cards that have an even greater range of possible values, including any value from one to eleven.

Bearing in mind the problems and deficiencies of the prior art, it is therefore an object of the present invention to provide a fast paced game using relatively few cards for each player's hand.

It is another object of the present invention to provide a method of playing a game having one or more wild cards that have a wider range of possible values than other wild card games.

A further object of the invention is to provide a game that will be familiar to and readily accepted by players who understand the rules of Blackjack or Twenty-One.

Still other objects and advantages of the invention will in part be obvious and will in part be apparent from the specification.

SUMMARY OF THE INVENTION

The above and other objects, which will be apparent to those skilled in art, are achieved in the present invention which is directed to a method of playing a card game and a deck of cards for playing the card game.

The object of the card game is to obtain a hand of cards having a value as close as possible to, or equal to, eleven. One or more players play directly against a dealer. The method of playing the card game includes providing a deck of cards having only number cards and one or more wild cards. Each number card has a value within the range of one through eight. Each wild card has any advantageous value from one to eleven. Because the most advantageous value is the value that makes the total value of a hand equal to eleven, wild cards are used to bring the total value of a player or dealer's hand to eleven.

The dealer deals a hand beginning with a first face-up card from the deck to the first player to his left. If there are additional players, the dealer also deals a face-up card to each additional player. A first face-down card is then dealt in front of the dealer. All subsequent cards are dealt face-up.

If a player has received one of the wild cards as the player's first card, the player wins the hand against the dealer, unless the dealer has also received one of the wild cards as the dealer's first card, in which case neither the player nor the dealer wins the hand and the hand is a tie. Conversely, the dealer wins the hand against the player if the dealer has received one of the wild cards as the dealer's first card, unless the player has also received one of the wild cards as the player's first card.

After the first cards are dealt, each player has the options of immediately resting, or requesting a single additional card and resting, or requesting multiple additional cards, one at a time, before resting. Additional cards are all dealt face-up. A player loses the hand to the dealer if an additional card requested by the player causes the total value of the cards dealt to the player to exceed eleven.

After each player has finished, the dealer turns the dealer's first card face-up. If the value of the dealer's first card is six or less, the dealer must take an additional card, dealt face-up. The dealer must continue to take face-up cards until the total value of the cards dealt to the dealer is seven or more.

If the total value of the cards dealt to the dealer exceeds eleven, the dealer loses to each remaining player who has a hand of eleven or less. The dealer wins the hand against a player if the total value of the cards dealt to the dealer exceeds the total value of the cards dealt to the player, provided, of course, the total value of the dealer's hand does not exceed eleven.

The player wins the hand against the dealer if the total value of the cards dealt to the player exceeds the total value of the cards dealt to the dealer, provided, of course, the total value of the player's hand has not previously exceeded eleven.

The steps of the method include:

providing a deck of cards having only number cards and one or more wild cards, each number card having a value solely within the range of one through eight and each wild card having any advantageous value from one to eleven;

a dealer dealing a hand beginning with a first face-up card from the deck to a player and a first face-down card to the dealer;

determining if the player has won the hand against the dealer after the first cards are dealt, the player winning the hand if the player has received one of the wild cards as the player's first card, unless the dealer has also received one of the wild cards as the dealer's first card, in which case neither the player nor the dealer wins the hand;

determining if the dealer has won the hand against the player after the first cards are dealt, the dealer winning the hand after the first cards are dealt if the dealer has received one of the wild cards as the dealer's first card, unless the player has also received one of the wild cards as the player's first card, in which case neither the player nor the dealer wins the hand;

after the first cards are dealt, the player selecting from the steps of:

immediately resting, or requesting a single additional card and resting, or requesting multiple additional cards, one at a time, before resting, the additional cards being dealt face-up;

determining if the player has lost the hand to the dealer after each additional card is dealt to the player, the player losing the hand after an additional card is dealt if the additional card requested by the player has caused the total value of the cards dealt to the player to exceed eleven;

turning the dealer's first card face-up after the player has rested with cards totaling eleven or less;

dealing an additional face-up card to the dealer if the value of the dealer's first card is six or less and continuing to deal additional cards to the dealer until the total value of the cards dealt to the dealer is seven or more, determining if the dealer has lost the hand to the player after each additional card is dealt to the dealer by determining if the total value of the cards dealt to the dealer has exceeded eleven;

determining if the dealer has won the hand against the player by determining if the total value of the cards dealt to the dealer has exceeded the total value of the cards dealt to the player; and determining if the player has won the hand against the dealer by determining if the total value of the cards dealt to the player has exceeded the total value of the cards dealt to the dealer.

Where there are multiple players, the step of dealing a hand includes the dealer dealing first face-up cards from the deck to additional players after dealing the first face-up card to the first player and before dealing the first face-down card to the dealer;

the step of determining if the player has won the hand against the dealer after the first cards are dealt includes a step of determining if each additional player has won the hand against the dealer after all the first cards are dealt, each additional player winning the hand if the additional player has received one of the wild cards as the additional player's first card, unless the dealer has also received one of the wild cards as the dealer's first card, in which case neither the additional player nor the dealer wins the hand;

the step of determining if the dealer has won the hand against the player after the first cards are dealt includes the step of determining if the dealer has won the hand against each additional player after all the first cards are dealt, the dealer winning the hand against the additional player after the first cards are dealt if the dealer has received one of the wild cards as the dealer's first card, unless the additional player has also received one of the wild cards as the additional player's first card, in which case neither the additional player nor the dealer wins the hand;

the step of the player selecting from steps includes a step of each additional player selecting from the steps of:

immediately resting, or requesting a single additional card and resting, or requesting multiple additional cards, one at a time, before resting, the additional cards being dealt face-up;

the step of determining if the player has lost the hand to the dealer after each additional card is dealt to the player is followed by a step of individually determining if each additional player has lost the hand to the dealer after each additional card is dealt to the additional player, the additional player losing the hand after an additional card is dealt if the additional card requested by the additional player has caused the total value of the cards dealt to the additional player to exceed eleven;

the step of determining if the dealer has lost the hand to the player after each additional card is dealt to the dealer includes a step of determining if the dealer has lost the hand to each additional player by determining if the total value of the cards dealt to the dealer has exceeded eleven;

the step of determining if the dealer has won the hand against the player includes a step of individually determining if the dealer has won the hand against each additional player by determining if the total value of the cards dealt to the dealer has exceeded the total value of the cards dealt to each additional player; and the step of determining if the player has won the hand against the dealer includes a step of individually determining if each additional player has won the hand against the dealer by determining if the total value of the cards dealt to each additional player has exceeded the total value of the cards dealt to the dealer.

In one embodiment of the invention directed to the cards for playing the game, the deck includes forty-eight number cards with equal quantities of number cards having the values from one to eight. Preferably, the deck of cards also includes four wild cards, making a fifty-two card deck.

In another embodiment of the invention directed to the cards for playing the game, N decks are shuffled together, N being a whole integer greater than or equal to one. In this deck, there are N times forty-eight number cards including equal quantities of cards having the values from one to eight, and preferably N times four wild cards, whereby the total quantity of cards in the deck is N times fifty-two.

In another aspect of the invention, during the optional step of the player requesting an additional card, the player also has an option, provided the first additional card has a value equal to the player's first card, of splitting the player's first card and first additional card and playing the two cards as separate hands against the dealer's cards.

In the most highly preferred method of the invention, the card game is played as gambling game. Each player makes a wager before any cards are dealt. Players who win the hand against the dealer are paid a winning amount. Players who lose the hand against the dealer lose the wager to the dealer. Players who tie retain their wager. The winning amount is preferably equal to the amount of the player's wager except when the player receives a wild card as the player's first card, in which case the winning amount is preferably twice the player's wager.

In yet another optional aspect of the invention, before the player has requested any additional cards, the player can elect to increase the player's wager, provided that the player immediately rests without additional cards, or requests only a single additional card and then rests. In the preferred method of the invention, player may increase the player's wager only up to the original amount of the player's wager.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–3 of the drawings in which like numerals refer to like features of the invention.

The present invention is a card game played between a dealer and one or more players. The object of the game is to end up with a hand of cards having a total value which equals eleven or is as close to eleven as possible without exceeding that value. Each player is dealt a hand and plays that hand against the dealer and not against the other players.

The game is played with a special deck of cards having only number cards and wild cards. The cards do not have any suits. The number cards range in value from one to eight, including all number values therebetween, and there are equal quantities of each number card. The wild cards can have any value desired as needed to make the total value of cards received by the player equal to eleven.

In one implementation of the invention, the game is played with a deck of fifty-two cards including four wild cards and forty-eight number cards. The forty-eight number cards include six cards having a value of one, six cards having a value of two, etc., up to six cards having a value of eight. In other implementations of the invention, multiple fifty-two card decks, as described above, are shuffled together.

The dealer or the house selects the number of decks to use. If the number of decks shuffled together is N (where N is a whole integer greater than or equal to one), there will be four times N wild cards and six times N of each number card. Where desired, the game may also be played with a greater or lesser number of wild cards. The deck described above for playing the game of this invention also forms a part of this invention.

The play begins by the dealer dealing a first card to each player and one to the dealer. The dealer starts with the player on the dealer's left and the dealer continues left to right, dealing a single card to each player, finishing by dealing a single card to the dealer. All cards dealt to players are dealt face-up. The first card dealt to the dealer is dealt face-down. All subsequent cards to the dealer or any player are dealt face-up.

Figure 1:
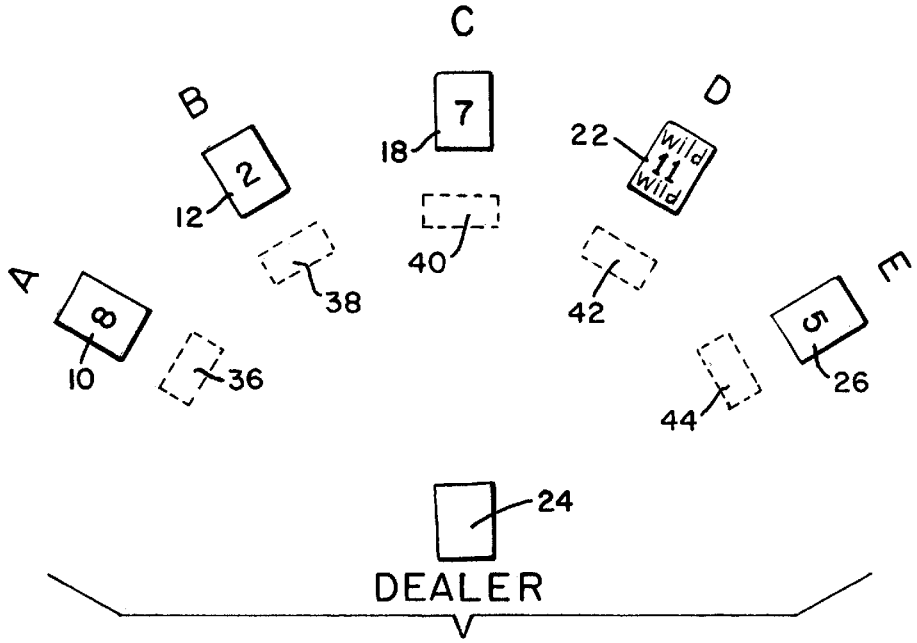
FIG. 1 shows a representative deal of a hand to five players and a dealer that may occur during play according to the present invention. Cards have been selected to illustrate various options for play available to the players. The hand is shown after first cards have been dealt to each player and to the dealer.

FIG. 1 shows the cards in a sample game, after the dealer has dealt the first round of cards to players A through E. There is always a single dealer, however, as many players may play as can be comfortably seated around a table. The cards in the sample hand of FIGS. 1–3 have been selected to illustrate various possible options for play available to the players.

After the first cards are dealt, each player has the opportunity to request additional cards, one by one, or to rest immediately. If a player elects to request an additional card, he loses if the additional card causes the total value of cards received by that player to exceed eleven. As play proceeds around the table from left to right, the dealer's first card 24 remains face-down.

In the sample hand of FIG. 1, player A has been dealt a first card 10. This first card is a number card having a value of eight. Accordingly, the total value of cards dealt to player A will exceed eleven if player A requests an additional card and that card has a value greater than three.

Figure 2:
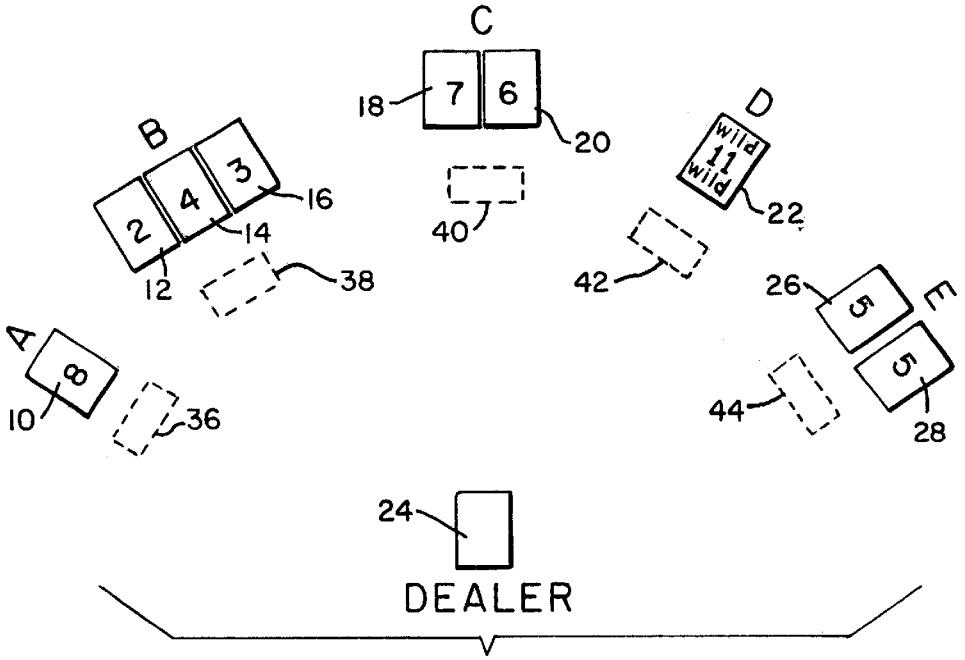
FIG. 2 shows the hand of cards in FIG. 1 after each player A–D has played and during the play of player E.

FIG. 2 illustrates the same hand as FIG. 1 after each player A–D has finished play, and during the middle of play with respect to player E. As can be seen in FIG. 2, player A has elected to rest immediately with a hand having a total value of eight. Each player plays after all players before him have finished their play.

Player B was initially dealt a first card 12 having a value of two. Player B decided to request a first additional card 14. This card has a value of four, which gave player B a hand having a total value of six (first card of value two plus second card of value four). Player B then elected to request another card and received a second additional card 16 having a value of three. This third card gave player B a hand having a total value of nine and player B then elected to rest.

Player C received an initial card 18 having a value of seven. Player C decided to request an additional card 20. This card had a value of six and the total value of player C's hand was then thirteen. Because this exceeds the maximum permitted value of eleven, player C "busts" and immediately loses the hand against the dealer. In the preferred method of play, the dealer would immediately remove a busted hand (a hand exceeding eleven) from the playing surface, however, player C's hand has been left in position In FIGS. 2 and 3 to illustrate the play.

Player D plays next. Player D has received a wild card 22 as his first card. The wild card gives player D a hand having a total value of eleven. Any player receiving a wild card as the first card wins the hand against the dealer, unless the dealer also receives a wild card as the dealer's first card. Accordingly, player D wins the hand against the dealer unless the dealer has also received a wild card. If both a player and the dealer receive a wild card as their first card, the hand is a tie between that player and the dealer. In the case of a tie, neither the player nor the dealer wins the hand against the other. A tie is also referred to as a "push."

Player E has been dealt a first card 26 having a value of five. Player E elects to receive an additional card 28 and is dealt another five. In the preferred implementation of the game, when a player is dealt a pair, as here, the player has the option of dividing the two cards and playing them as two separate hands. This is known as "splitting a pair."

Figure 3:
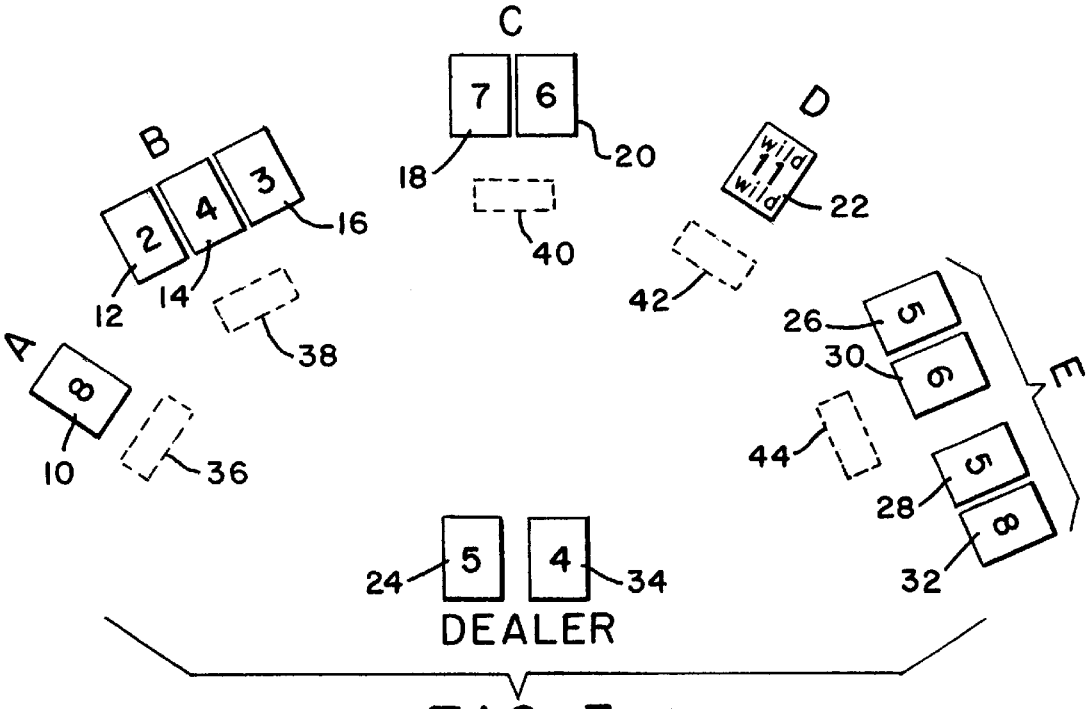
FIG. 3 shows the hand of cards in FIG. 2 after the dealer has played and the hand is finished.

FIG. 3 illustrates splitting a pair. Player E has split the initial pair of fives (cards 26 and 28) and played them as two separate hands. The hands must be played individually and the player must request cards for the first hand and then rest before requesting cards for the second hand. Player E requests an additional card 30 for his first hand and receives a six giving the first hand (composed of cards 26 and 30) a total value of eleven. Player E rests this first hand.

Player E then requests an additional card for his second hand. He receives an additional card 32 having a value of eight and this hand busts with a total value of thirteen (cards 28 and 32). If player E had received as his first additional card 30 another card having the same value of the first two cards (i.e., a value of five) player E would be permitted to again divide his hand and could continue dividing his hand so long as he continued to receive cards of the same value as the first two cards up to a maximum of five hands. In variations of the game this maximum number of splits may be raised or reduced.

After all of the players have rested or busted, the dealer turns his first card 24 face-up. If the dealer's card has a value of six or less, the dealer is required to take an additional card. The dealer must continue to take additional cards until the total value of the cards in the dealer's hand is seven or more. In the illustration of FIG. 3, the dealer receives an additional card 34 having a value of four. This causes the dealer's hand to have a total value of nine and the dealer must then rest. The dealer's hand is then compared against each player's hand.

Between player A and the dealer, the dealer wins because the value of the dealer's hand (nine) is greater than the total value of player A's hand (eight). Between player B and the dealer, the hand is a tie because both the player and the dealer have hands with a total value of nine. Neither player B nor the dealer wins against the other. Player C has busted and accordingly the dealer wins the hand against player C.

Between player D and the dealer, player D wins the hand because player D received a wild card as the first card and the dealer did not receive a wild card. Player D would win against the dealer even if the dealer achieved a hand having a total value of eleven, provided that the dealer's first card was not a wild card. If the dealer had received a wild card as the dealer's first card, the hand would have been a tie between the dealer and player D.

Between player E and the dealer, player E wins with his first hand of value eleven (comprising cards 26 and 30) and loses with respect to the second hand (comprising cards 28 and 32) because that hand busted (value thirteen). If the dealer's hand busts, the dealer loses against all other players who have not busted.

As soon as the dealer has received a card causing the total value of his hand to exceed six, the dealer must rest and the hand is over.

The game may be played by simply tracking total wins or loses and rotating the dealer position. However the preferred method of playing the game includes wagering on the game as a game of chance. When played as a game of chance, each player makes an initial wager prior to any cards being dealt. The money or chips comprising the wager are placed in a designated area for each players bet, such as areas 36, 38, 40, 42 or 44. Each player is wagering against the dealer and not against the other players. No hand is paid until the dealer's hand is complete.

In the preferred implementation of the game, if a player receives a wild card as the player's first card (as illustrated for player D) and the dealer does not receive a wild card for the dealer's first card, the player wins and the dealer must pay to the player an amount equal to twice the amount wagered by the player.

If a player divides his hand (as illustrated for player E) the player may wager on each hand an amount equal to the original bet made by the player at the commencement of the hand. Each split or division of the cards by a player gives that player an opportunity to make an additional wager on each divided hand of an amount equal to the amount wagered on the original hand.

If a player wins the hand against the dealer, the player is paid an amount equal to the amount of the player's original wager. An example of this is player E's first hand composed of cards 26 and 30. If a player's hand has the same value as the dealer's hand, either because both have received wild cards as their first cards or because the face value of the player's hand equals the face value of the dealer's hand, then neither party wins, the hand is a tie and the player retains his wager originally made on the hand. An example of this is player B's hand. Players who have lost the hand either by busting (e.g. player C) or by having a value less than the value of the dealer's hand (e.g. player A) lose their wager to the dealer.

In another optional aspect of the invention, a player may increase his initial wager up to the amount of the player's original wager if he elects to do this after receipt of the first card and before receipt of any additional cards. If the player elects to increase his wager in this way, the player must either rest immediately with the first card or the player may request one additional card and then rest. Under this optional play, the player may not request more than one additional card. This optional play is referred to as "double down."

Although the invention has been described in terms of conventional playing cards that can be handled and dealt onto the surface of a table, the method of the invention may also be easily implemented through conventional computer programming techniques in video form on a computer screen. The cards of the invention may be displayed with graphical representations of cards on the computer screen and the playing card deck of the invention may be constructed by a computer program that tracks the cards being dealt, the number of cards remaining, etc.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of playing a card game comprising the steps of:

providing a deck of cards having only number cards and one or more wild cards, each number card having a value solely within the range of one through eight and each wild card having any advantageous value from one to eleven;

a dealer dealing a hand beginning with a first face-up card from the deck to a player and a first face-down card to the dealer;

determining if the player has won the hand against the dealer after the first cards are dealt, the player winning the hand if the player has received one of the wild cards as the player's first card, unless the dealer has also received one of the wild cards as the dealer's first card, in which case neither the player nor the dealer wins the hand;

determining if the dealer has won the hand against the player after the first cards are dealt, the dealer winning the hand after the first cards are dealt if the dealer has received one of the wild cards as the dealer's first card, unless the player has also received one of the wild cards as the player's first card, in which case neither the player nor the dealer wins the hand;

after the first cards are dealt, the player selecting from the steps of:

immediately resting, or requesting a single additional card and resting, or requesting multiple additional cards, one at a time, before resting, the additional cards being dealt face-up;

determining if the player has lost the hand to the dealer after each additional card is dealt to the player, the player losing the hand after an additional card is dealt if the additional card requested by the player has caused the total value of the cards dealt to the player to exceed eleven;

turning the dealer's first card face-up after the player has rested with cards totaling eleven or less;

dealing an additional face-up card to the dealer if the value of the dealer's first card is six or less and continuing to deal additional cards to the dealer until the total value of the cards dealt to the dealer is seven or more, determining if the dealer has lost the hand to the player after each additional card is dealt to the dealer by determining if the total value of the cards dealt to the dealer has exceeded eleven;

determining if the dealer has won the hand against the player by determining if the total value of the cards dealt to the dealer has exceeded the total value of the cards dealt to the player; and determining if the player has won the hand against the dealer by determining if the total value of the cards dealt to the player has exceeded the total value of the cards dealt to the dealer.

2. The method of playing a card game according to claim 1 wherein:

the step of dealing a hand includes the dealer dealing first face-up cards from the deck to additional players after dealing the first face-up card to the first player and before dealing the first face-down card to the dealer;

the step of determining if the player has won the hand against the dealer after the first cards are dealt includes a step of determining if each additional player has won the hand against the dealer after all the first cards are dealt, each additional player winning the hand if the additional player has received one of the wild cards as the additional player's first card, unless the dealer has also received one of the wild cards as the dealer's first card, in which case neither the additional player nor the dealer wins the hand;

the step of determining if the dealer has won the hand against the player the first cards are dealt includes the step of determining if the dealer has won the hand against each additional player after all the first cards are dealt, the dealer winning the hand against the additional player after the first cards are dealt if the dealer has received one of the wild cards as the dealer's first card, unless the additional player has also received one of the wild cards as the additional player's first card, in which case neither the additional player nor the dealer wins the hand;

the step of the player selecting from steps includes a step of each additional player selecting from the steps of:

immediately resting, or requesting a single additional card and resting, or requesting multiple additional cards, one at a time, before resting, the additional cards being dealt face-up;

the step of determining if the player has lost the hand to the dealer after each additional card is dealt to the player is followed by a step of individually determining if each additional player has lost the hand to the dealer after each additional card is dealt to the additional player, the additional player losing the hand after an additional card is dealt if the additional card requested by the additional player has caused the total value of the cards dealt to the additional player to exceed eleven;

the step of determining if the dealer has lost the hand to the player after each additional card is dealt to the dealer includes a step of determining if the dealer has lost the hand to each additional player by determining if the total value of the cards dealt to the dealer has exceeded eleven;

the step of determining if the dealer has won the hand against the player includes a step of individually determining if the dealer has won the hand against each additional player by determining if the total value of the cards dealt to the dealer has exceeded the total value of the cards dealt to each additional player; and the step of determining if the player has won the hand against the dealer includes a step of individually determining if each additional player has won the hand against the dealer by determining if the total value of the cards dealt to each additional player has exceeded the total value of the cards dealt to the dealer.

3. The method of playing a card game according to claim 2 wherein the total number of players is seven or less.

4. The method of playing a card game according to claim 1 wherein the deck includes forty-eight number cards with equal quantities of number cards having the values from one to eight.

5. The method of playing a card game according to claim 4 wherein the deck includes four wild cards.

6. The method of playing a card game according to claim 1 wherein the deck includes number cards in a quantity of N times forty-eight, the number cards including equal quantities of cards having the values from one to eight and N being a whole integer greater than or equal to one.

7. The method of playing a card game according to claim 6 wherein the deck includes wild cards in the quantity of N times four whereby the total quantity of cards in the deck is N times fifty-two.

8. The method of playing a card game according to claim 6 further including a step of the dealer selecting the size of N to determine the quantity of number cards in the deck.

9. The method of playing a card game according to claim 1 wherein during the optional step of the player requesting an additional card, the player also has an option, provided the first additional card has a value equal to the player's first card, of splitting the player's first card and first additional card and playing the two cards as separate hands against the dealer's cards.

10. The method of playing a card game according to claim 1 further including the steps of:

the player making a wager before any cards are dealt;

paying the player a winning amount if the player wins the hand;

the dealer collecting the wager if the player loses the hand; and the player retaining the wager if neither the player nor the dealer wins the hand.

11. The method of playing a card game according to claim 10 wherein the winning amount is equal to the amount of the wager by the player.

12. The method of playing a card game according to claim 10 wherein during the optional step of the player requesting an additional card, the player also has an option, provided the first additional card has a value equal to the player's first card, of splitting the player's first card from the player's first additional card and playing the first additional card as the first card of a second hand against the dealer's cards according to the steps of claim 1, the player making a second wager on the second hand.

13. The method of playing a card game according to claim 12 wherein the second wager on the second hand is equal to the first wager on the first hand.

14. The method of playing a card game according to claim 12 wherein during the playing of the first and second hands, the player has the continued option of splitting the player's cards from the first or second hands to form additional hands provided the first additional card for either hand has a value equal to the player's first card.

15. The method of playing a card game according to claim 10 wherein during the step of the player selecting from steps, the player has the option of increasing the player's wager provided the player selects the step of immediately resting, or the step of requesting a single additional card and then resting.

16. The method of playing a card game according to claim 15 wherein the player may increase the player's wager only up to the original amount of the player's wager.

17. The method of playing a card game according to claim 10 wherein the step of paying the player a winning amount if the player wins the hand comprises paying the player twice the wager if the player has won the hand against the dealer by receiving one of the wild cards as the player's first card, and paying the player the amount of the wager if the player has won the hand against the dealer by receiving a total value of cards that exceeds the total value of cards dealt to the dealer.

18. A method of playing a card game comprising the steps of:

providing a deck of cards having only number cards and one or more wild cards, each number card having a value solely within the range of one through eight and each wild card having any advantageous value from one to eleven;

a plurality of players making corresponding wagers;

a dealer dealing a hand beginning with a first face-up card from the deck to each player and a first face-down card to the dealer;

after the first cards are dealt, individually determining if each player has won the hand against the dealer, each player individually winning the hand against the dealer if the player has received one of the wild cards as the player's first card, unless the dealer has also received one of the wild cards as the dealer's first card, in which case neither the player nor the dealer wins the hand and the hand is a push;

after the first cards are dealt, determining if the dealer has won the hand against all remaining players who have not received a first wild card, the dealer winning the hand against all remaining players who have not received a first wild card, and the hand being over, if the dealer has received one of the wild cards as the dealer's first card;

after the first cards are dealt, and provided the hand is not over, a first player from among the remaining plurality of players deciding when to rest by selecting from the steps of:

immediately resting, or requesting a single additional card and resting, the additional card being dealt face-up, or requesting multiple additional cards, one at a time, before resting, the additional cards all being dealt face-up;

determining if the first player has individually lost the hand to the dealer if the player has decided to request additional cards, the determination being made after each additional card is dealt to the player, the player losing the hand after an additional card is dealt if the additional card requested by the player has caused the total value of the cards dealt to the player to exceed eleven;

for each other remaining player, repeating the steps of deciding when to rest and determining if the other player has individually lost the hand to the dealer;

turning the dealer's first card face-up after each remaining player has rested;

dealing an additional face-up card to the dealer if the value of the dealer's first card is six or less and continuing to deal additional cards to the dealer until the total value of the cards dealt to the dealer is seven or more, determining if the dealer has lost the hand to all remaining player after each additional card is dealt to the dealer by determining if the total value of the cards dealt to the dealer has exceeded eleven;

individually determining if the dealer has won the hand against each remaining player by separately determining if the total value of the cards dealt to the dealer has exceeded the total value of the cards dealt to the remaining player; and individually determining if each remaining player has won the hand against the dealer by separately determining if the total value of the cards dealt to each remaining player has exceeded the total value of the cards dealt to the dealer.

* * * * *